US008573121B2

(12) United States Patent
Barton

(10) Patent No.: US 8,573,121 B2
(45) Date of Patent: Nov. 5, 2013

(54) METHODS, APPARATUS, AND SYSTEMS FOR ERASING INK HISTORY FROM INK TRANSFER ROLL IN DIGITAL OFFSET SYSTEMS

(75) Inventor: Augusto E. Barton, Palo Alto, CA (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/156,734

(22) Filed: Jun. 9, 2011

(65) Prior Publication Data

US 2012/0312182 A1 Dec. 13, 2012

(51) Int. Cl.
*B41F 35/00* (2006.01)

(52) U.S. Cl.
USPC ..... 101/423; 101/483

(58) Field of Classification Search
USPC ..... 101/423
See application file for complete search history.

(56) References Cited

U.S. PATENT DOCUMENTS

| | | | | |
|---|---|---|---|---|
| 4,237,785 | A * | 12/1980 | Dahlgren | 101/141 |
| 4,729,310 | A * | 3/1988 | Love, III | 101/157 |
| 6,050,189 | A * | 4/2000 | Junghans et al. | 101/211 |
| 6,371,018 | B1 * | 4/2002 | Nacash et al. | 101/211 |
| 6,401,608 | B1 * | 6/2002 | Lyon et al. | 101/136 |
| 6,568,324 | B1 * | 5/2003 | Franklin et al. | 101/364 |
| 6,928,930 | B1 * | 8/2005 | Gottling et al. | 101/424 |
| 6,982,735 | B2 * | 1/2006 | Moore et al. | 347/125 |
| 7,409,910 | B2 * | 8/2008 | Schneider et al. | 101/491 |
| 7,726,240 | B2 * | 6/2010 | Saito et al. | 101/424 |
| 7,963,226 | B2 * | 6/2011 | Schneider et al. | 101/486 |

* cited by examiner

*Primary Examiner* — Anthony Nguyen
(74) *Attorney, Agent, or Firm* — Ronald E. Prass, Jr.; Prass LLP

(57) ABSTRACT

A digital offset inking system includes an ink chamber that contains ink, and deposits ink onto an inking member. The ink is transferred to an ink transfer member, which is then transferred to an image transfer member. An ink removal member removes leftover or excess ink from the ink removal member. A cleaning member cleans the ink removal member.

16 Claims, 4 Drawing Sheets

METHODS, APPARATUS, AND SYSTEMS FOR ERASING INK HISTORY FROM INK TRANSFER ROLL IN DIGITAL OFFSET SYSTEMS

FIELD OF DISCLOSURE

The disclosure relates to methods and systems for inking to a digital offset plate. In particular, the disclosure relates to ghostless inking systems for inking from, for example, an inking system having an anilox roll and a rubber transfer roll to a digital offset plate.

BACKGROUND

Inking systems are designed to transfer ink to offset plates. An inking system may be a keyed or key-less type. An inking system may be a regular offset-type printing system, or a digital offset plate printing system.

Related art inking systems can suffer from ghosting issues. In inking systems, transferred ink may be deposited in a layer. The layer may have areas of varying thickness. Ghosting can result from an ink layer being thinner in a particular area where an image has been previously transferred. Areas of thinner ink in ink layers typically cause corresponding lighter areas in image prints.

In related art systems, and particularly in, e.g., regular offset systems, ghosting issues may be addressed by using inker rolls that each have about the same diameter. Such an arrangement causes a repeating image to always be on the same location on the rolls, and circumvents the effects of ghosting.

SUMMARY

For digital offset, however, a key-less inker having reduced ghosting is needed. An inking system that is effective in reducing, minimizing, and/or preventing ghosting is provided. Specifically, embodiments of methods, apparatus, and systems accommodate erasing ink history, e.g., removing leftover ink, from an ink transfer member to prevent ghosting.

For example, embodiments of methods include removing leftover ink from an ink transfer member using at least one of a urethane coated member and a ceramic member. An inking system may include an inking member, such as an anilox roll, configured to carry ink to an ink transfer member. The ink transfer member may be configured to carry ink to an imaging member. The imaging member may be an offset plate.

After the ink transfer member contacts the imaging member to transfer ink from the ink transfer member to the imaging member, ink that remains on the ink transfer member may be removed to reduce ghosting, or erase ink history. In embodiments of methods, apparatus, and systems, the ink may be removed using an ink removal member comprising an oleophilic surface. For example, embodiments of methods, apparatus, and systems may include an ink removal member having an oleophilic ceramic surface. The ink transfer member may comprise, e.g., a rubber surface.

In alternative embodiments of methods, apparatus, and systems, an ink removal member may comprise an oleophilic urethane surface. A cleaning member having an oleophilic ceramic surface may be used to remove ink from the urethane surface of the ink removal member. For example, the ceramic surface of the cleaning member may be less oleophilic than the urethane surface of the ink removal member. A doctor blade may be used to remove ink from a surface of the cleaning member.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
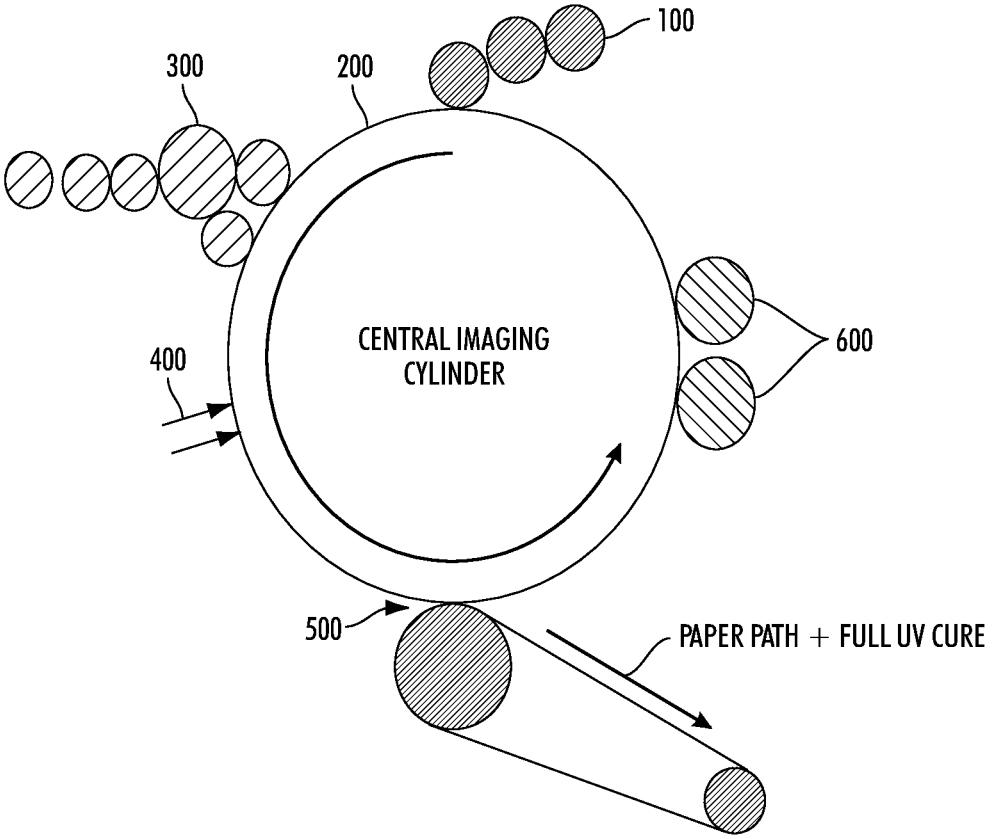
FIG. 1 shows a digital offset architecture.

Exemplary embodiments are intended to cover all alternatives, modifications, and equivalents as may be included within the spirit and scope of the apparatus and systems as described herein.

Reference is made to the drawings to accommodate understanding of methods, apparatus, and systems for inking from an ink transfer member to a digital offset plate, and erasing an ink history of the ink transfer member. In the drawings, like reference numerals are used throughout to designate similar or identical elements. The drawings depict various embodiments and data related to embodiments of illustrative methods, apparatus, and systems for inking directly from an ink transfer member to an imaging member.

Methods, apparatus, and systems of embodiments are preferably keyless and accommodate ghostless inking to a digital offset plate from an ink transfer member, and erasing an ink history from the transfer member. FIG. 1 shows a digital offset architecture that may be included in systems of embodiments. Specifically, FIG. 1 shows a central imaging cylinder and a paper path architecture that together form a media transfer nip. FIG. 1 shows the steps of a digital offset that occur about the central imaging cylinder. For example, a uniform application of fountain solution may be applied to a surface of the central imaging cylinder by a dampening system in a fountain solution application step 100. In a digital evaporation step 200, particular portions of the fountain solution layer applied to the surface of the central imaging cylinder may be evaporated by a digital evaporation system. For example, portions of the fountain solution layer may be evaporated by laser patterning using, for example, a Texas Instruments DLP projector chip.

In an inking step 300, ink may be transferred from an inking member to the surface of the central imaging cylinder. The transferred ink adheres to portions of the surface of the central imaging cylinder where a fountain solution has been evaporated. In a partial cure step 400, the transferred ink may be partially cured by irradiation, for example, UV cure. In an image transfer step 500, the transferred ink may be transferred to media such as paper at a media transfer nip.

In a step 600, a surface of the central imaging cylinder may be cleaned by a cleaning system. For example, trace cleaning rollers may be used to clean the surface of the central imaging cylinder.

Ink may be transferred to a central imaging cylinder, as shown in inking step 300 of FIG. 1, from an inking member and ink transfer member of an inking system. An inking member may be, for example, an anilox roll having wells or cells for containing ink to be transferred to the imaging member. The wells may be mechanically or laser engraved, and may be configured to contain a volume of ink. Inking systems of embodiments include a system for removing excess ink from one or more cells. For example, ink may be deposited onto an inking member by an ink chamber so that ink fills and overflows one or more wells of the inking member. In accordance with methods of embodiments, the one or more wells may be leveled to remove excess ink from a surface of the inking member, e.g., by removing the ink overflow using a doctor blade.

For example, the ink chamber may be associated with a doctor blade or similar suitable structure. The doctor blade may be configured to doctor excess ink deposited in a cell of the inking member from the surface of the inking member. A chamber blade may be associated with the ink chamber. The chamber blade and the doctor blade may be configured to contain ink within the chamber. For example, the chamber blade, inking member, and doctor blade, in combination, may be configured to contain ink inside the ink chamber. Ink containment may be further facilitated by seals such as side seals.

The inking member, which may be an anilox roll, for example, may be configured to translate rotatably about a central longitudinal axis. Ink may be deposited by the ink chamber into one or more cells of an inking member when the inking member is at a first position. The inking member may be rotated to a second position at which the deposited ink is transferred to an ink transfer member, which may have a surface comprising rubber. The ink may then be transferred to an imaging member or a digital offset transfer plate. The imaging member may be a central imaging cylinder, such as that diagrammatically shown in FIG. 1, and ink may be transferred to the imaging member from an inking system in an inking step 300.

Embodiments of methods, apparatus, and systems include removing ink from an ink transfer member to prevent ghosting and accommodate a ghostless inking system. For example, embodiments of methods include removing ink from an ink transfer member using at least one of a urethane coated member and a ceramic member.

After the ink transfer member contacts the imaging member to transfer ink from the ink transfer member to the imaging member, ink that remains on the ink transfer member may be removed. When a rubber ink transfer member, for example, is employed as part of the ink train, ghosting may result from existence of an ink thickness transient. In embodiments of methods, apparatus, and systems, the ink may be removed using an ink removal member comprising an oleophilic surface. For example, embodiments of methods, apparatus, and systems may include an ink removal member having an oleophilic ceramic surface. The ink transfer member may comprise, e.g., a rubber surface. A doctor blade or equivalent mechanism may be used to remove the ink from the ceramic surface of the cleaning member.

In alternative embodiments of methods, apparatus, and systems, an ink removal member may comprise an oleophilic urethane surface. A cleaning member having an oleophilic ceramic surface may be used to remove ink from the urethane surface of the ink removal member. The ceramic surface of the cleaning member may be less oleophilic than the urethane surface of the ink removal member. A doctor blade may be used to remove ink from a surface of the cleaning member.

During transfer of the deposited ink from the inking member to the imaging member or digital offset transfer plate, fountain solution from the surface of the inking member may be transferred to the inking member. In embodiments, the inking member may be rotated to a third position at which the fountain solution may be removed from a surface of the inking member.

A fountain solution removal system may be configured to remove fountain solution. For example, a fountain solution removal system may include a doctor blade that is configured to remove fountain solution. In an alternative embodiment, the fountain solution removal system may include an air knife that is configured to evaporate fountain solution from a surface of the inking member. In another alternative embodiment, the fountain solution removal system may include a combination of at least a fountain solution doctor blade and an air knife for removing fountain solution transferred from the imaging member to the inking member.

Figure 2:
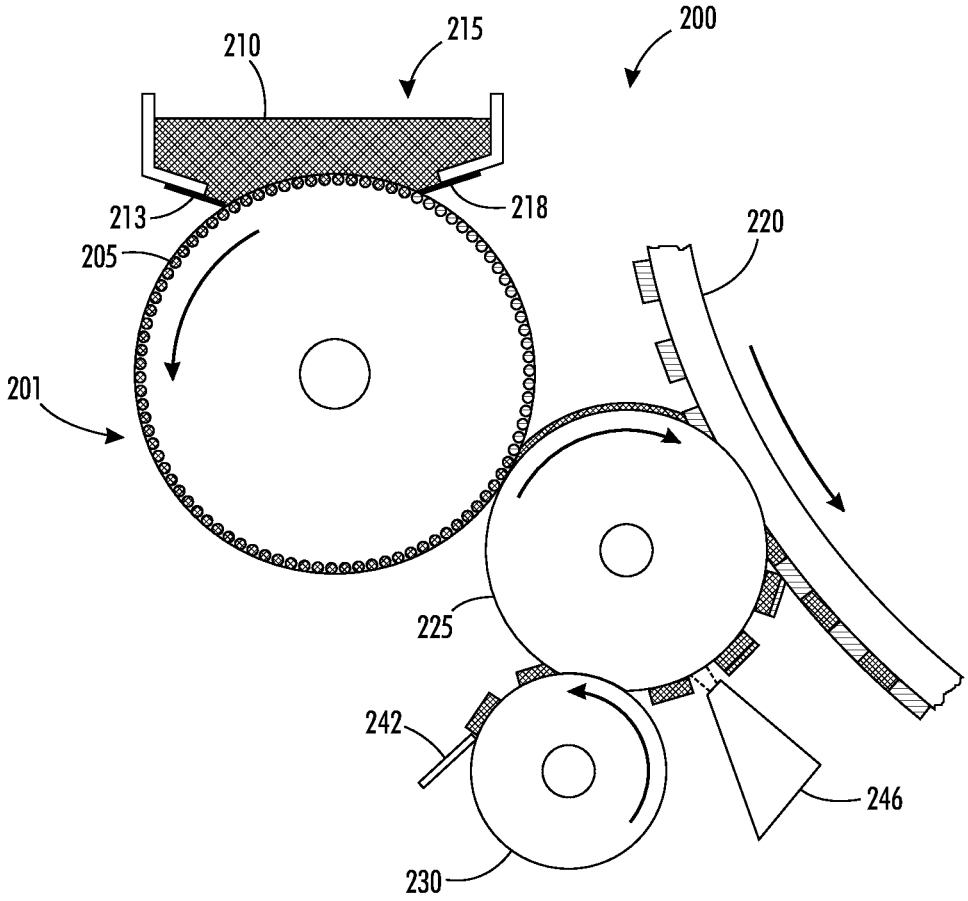
FIG. 2 shows an inking system in accordance with an exemplary embodiment.

FIG. 2 shows an exemplary inking system in accordance with an embodiment. Specifically, FIG. 2 shows an inking digital offset system 200. The digital offset system 200 includes an inking system 201 having an inking member 205. An ink chamber 215 may be positioned adjacent to the inking member 205. The ink chamber 215 may be configured to deposit ink into one or more wells of the inking member 205.

For example, the inking member 205 may include a surface having one or more wells or cells configured to hold ink deposited by the ink chamber 215. The cells may be structured to have a tri-helical shape, or a quad-channel shape, or otherwise structured for preferably permitting smoother solids and better ink fluidity and transfer for high viscosity inks, e.g., about 400,000 cps. Such high viscosity inks are a typical selection for digital offset applications. The cells may be mechanically engraved or laser-engraved.

The ink chamber 215 may be associated with a chamber blade 213 and a doctor blade 218. The chamber blade 213 may be configured to contain ink 210 within the ink chamber 215. Ink containment may be enhanced with the combination of doctor blade 218 and chamber blade 213. Seals such as side seals may be used to enhance ink containment.

FIG. 2 shows the chamber blade 213 and the doctor blade 218 being configured and arranged to contain the ink in the ink chamber 215. The inking member 205 may also be positioned to facilitate containment of the ink within ink chamber 215 as shown in FIG. 2. Ink 210 may be deposited by the ink chamber 215 in one or more cells of the inking member 205. The deposited ink may be transferred to a surface of an imaging member 220.

In accordance with an embodiment, the inking system 201 of FIG. 2 includes an ink transfer member 225 that is positioned adjacent to the inking member 205. In the inking system 201 shown in FIG. 2, the ink may be deposited on a surface of the inking member 205. In an embodiment, the ink 210 may be deposited in one or more cells defined by or formed on a surface of the inking member 205.

The inking member 205 may be a rotatable roll, as shown, which may be rotated to carry deposited ink for transfer to the ink transfer member 225. For example, the ink member 205 may be an anilox roll. Specifically, the inking member 205 may be rotated from a first position at which ink 210 from the ink chamber 215 may be deposited on the inking member 205, to a second position at which the ink may be transferred to the ink transfer member 225.

The ink transfer member 225 may be positioned adjacent to the imaging member 220. The ink transfer member 225 may be a rotatable roll, as shown, which may be rotated from a first position at which ink may be transferred from the inking member 205 to the ink transfer member 225, to a second position at which the transferred ink may be transferred to the imaging member 220.

After ink is transferred from the ink transfer member 225 to the imaging member 220, the ink transfer member 225 may contain leftover ink on a portion of the ink transfer member 225 from which ink was transferred to the imaging member 220. It is advantageous to remove the leftover ink before that portion of the ink transfer member 225 is again positioned to accept ink transferred from the inking member 205.

An ink removal system including an ink removal member may be used to remove leftover or remaining ink from the ink transfer member 225. For example, FIG. 2 shows an ink removal member 230 that is operably positioned and arranged adjacent to the ink transfer member 225. The ink removal member 230 may be a rotatable roll, and may be configured to roll in a direction that is opposite from the direction in which the ink transfer member 225 rotates. As the ink removal member 230 contacts the ink transfer member 225, leftover ink may be transferred from the ink transfer member 225 to the ink removal member 230. After the leftover ink is transferred to the ink removal member 230, the ink may be removed from the ink removal member. For example, a doctor blade 242 may be positioned to remove transferred leftover ink from a surface of the ink removal member 230.

A surface of the ink removal member 230 may be oleophilic. For example, in an embodiment, a surface of the ink removal member 230 may comprise ceramic, or a ceramic coating. The ceramic coating provides an oleophilic surface that contacts a surface of the ink transfer member 225.

During the ink transfer process, fountain solution located on a surface of the imaging member 220 may be transferred to the ink transfer member 225. The fountain solution transferred to the ink transfer member 225 may be removed by a fountain solution removal system. For example, the inking member 225 may be rotatable from an ink transfer position to a fountain solution removal position as shown in FIG. 2. The fountain solution removal system may include an air knife 246. The air knife 246 may be positioned and configured to remove fountain solution from a surface of the ink transfer member 225.

Figure 3:
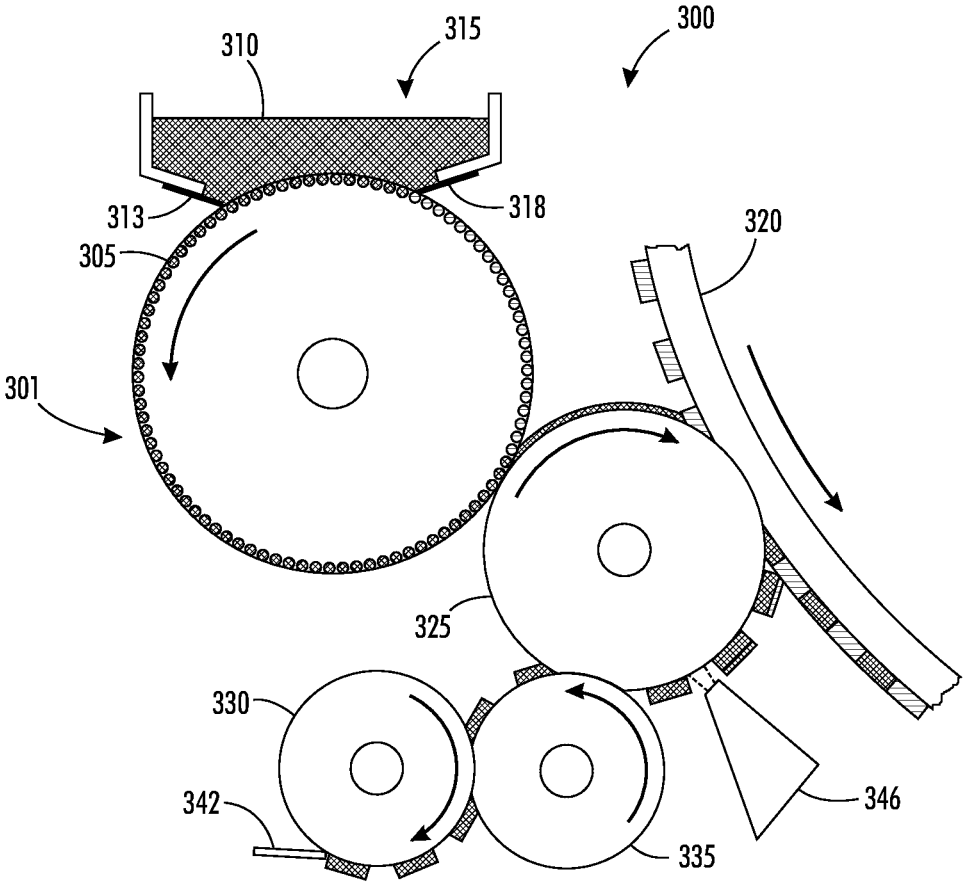
FIG. 3 shows an inking system in accordance with another exemplary embodiment.

FIG. 3 shows an exemplary inking system in accordance with an embodiment. Specifically, FIG. 3 shows a inking digital offset system 300. The digital offset system 300 includes an inking system 301 having an inking member 305 on which ink 310 is deposited. An ink chamber 315 may be positioned adjacent to the inking member 305. The ink chamber 315 may be configured to deposit contain, and deposit ink 310 into one or more wells of the inking member 305.

For example, the inking member 305 may include a surface having one or more wells or cells configured to hold ink 310 deposited by the ink chamber 315. The cells may be structured to have a tri-helical shape, or a quad-channel shape, or otherwise structured for permitting smoother solids and better ink fluidity and transfer for high viscosity inks, e.g., about 400,000 cps. Such high viscosity inks are a typical selection for digital offset applications. The cells may be mechanically or laser-engraved.

The ink chamber 315 may be associated with a chamber blade 313 and a doctor blade 318. The chamber blade 313 may be configured to contain ink 310 within the ink chamber 315. Containment of ink 310 may be enhanced with the combination of doctor blade 318 and chamber blade 313. Containment may be enhanced by using seals, such as side seals. FIG. 3 shows the chamber blade 313 and the doctor blade 318 being configured and arranged to contain the ink 310 in the ink chamber 315. The inking member 305 may be configured and positioned to facilitate containment of the ink 310 within ink chamber 315 as shown in FIG. 3. Ink may be deposited by the ink chamber 315 in one or more cells of the inking member 305. The deposited ink may be transferred to a surface of an imaging member 320.

In accordance with an embodiment, the inking system 301 of FIG. 3 includes an ink transfer member 325 that is positioned adjacent to the inking member 305. In the inking system 301 shown in FIG. 3, the ink may be deposited on a surface of the inking member 305. For example, the ink 310 may be deposited in one or more cells defined by or formed on a surface of the inking member 305.

The inking member 305 may be a rotatable roll, which may be rotated to carry deposited ink for transfer to the ink transfer member 325. Specifically, the inking member 305 may be rotated from a first position at which ink from the ink chamber 315 may be deposited on the inking member 305, to a second position at which the ink may be transferred to the ink transfer member 325.

The ink transfer member 325 may be positioned adjacent to the imaging member 320. The ink transfer member 325 may be a rotatable roll, as shown, which may be rotated from a first position at which ink may be transferred from the inking member 305 to the ink transfer member 325, to a second position at which the transferred ink may be transferred to the imaging member 320. The ink transfer member 325 may include a surface comprising rubber or similar material.

After ink is transferred from the ink transfer member 325 to the imaging member 320, the ink transfer member 325 may contain leftover ink on a portion of the ink transfer member 325 from which ink was transferred to the imaging member 320. It is advantageous to remove the left over ink before that portion of the ink transfer member 325 is again positioned to accept ink transferred from the inking member 305.

In an embodiment, as shown in FIG. 3, an ink removal system including an ink removal member and a cleaning member may be used to remove left over ink from the ink transfer member 325. For example, FIG. 3 shows an ink removal member 330 that is operably positioned and arranged adjacent to a cleaning member 335. The ink removal member 335 may be operably positioned and arranged adjacent to the ink transfer member 325.

The cleaning member 330 and the ink removal member 335 may be rotatable rolls. They may be configured, for example, to rotate in a direction that is opposite from the direction in which immediately adjacent rolls rotate. As the ink removal member 335 contacts the ink transfer member 325, leftover ink may be transferred from the ink transfer member 325 to the ink removal member 335. After the leftover ink is transferred to the ink removal member 335, the ink may be removed from the ink removal member 335.

The cleaning member 330 may be positioned to contact the ink removal member 335, and remove ink from the ink removal member 335. A surface of the cleaning member 330 may be oleophilic. For example, in an embodiment as shown in FIG. 3, a surface of the cleaning member 330 may comprise ceramic. A surface of the ink removal member 335 may comprise urethane. The urethane surface of the ink removal member 335 may be more oleophilic than the ceramic surface of the cleaning member 330.

After ink is removed from the ink removal member 335 by the cleaning member 330, the ink may be removed from the cleaning member 330. For example, a doctor blade 342 may be positioned to remove transferred leftover ink from a surface of the ink removal member 330.

During the ink transfer process, fountain solution located on a surface of the imaging member 320 may be transferred to the ink transfer member 325. The fountain solution transferred to the ink transfer member 325 may be removed by a fountain solution removal system. In an embodiment, the ink transfer member 325 may be rotatable from an ink transfer position at which ink may be transferred from the ink transfer member 325 to the imaging member 320, to a second position at which a fountain solution removal system is positioned. As shown in FIG. 3, the fountain solution removal system may include an air knife 346. The air knife 346 may be positioned and configured to remove fountain solution from a surface of the ink transfer member 325.

An inking member of embodiments may be an anilox roll. The ink used in the inking system may be a high viscosity ink. For example, the ink may have a viscosity on the order of 400,000 cps. To facilitate inks of this viscosity and similar viscosities, the anilox roll may be configured to include a surface that defines cells having high-viscosity ink-accommodating patterns.

A surface of the inking member may include or define a cell pattern having a tri-helical structure. Alternatively, a cell pattern structured to have a quad-channel arrangement may defined by a surface of the inking member. Such cell or ink well types permit smoother solids and better ink fluidity, and improved transfer for high viscosity inks. Accordingly, such cell pattern structures may be particularly suitable for inks typically used in digital offset processes. In embodiments, the inking member may be an anilox roll that has mechanically engraved, or laser engraved cells.

Transient tests show that there is an ink thickness transient that occurs in an ink transfer roll. Tests show that it takes about three to four revolutions of an ink transfer roll for the transient to arrive at a steady-state ink thickness.

Figure 4:
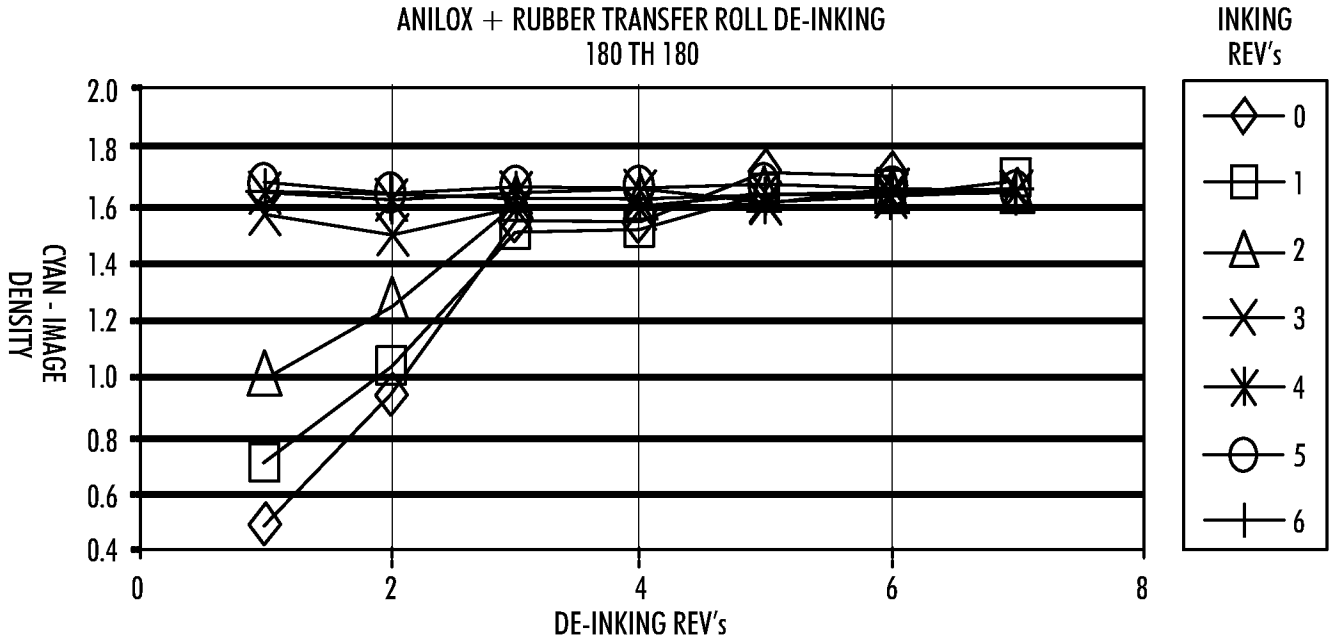
FIG. 4 shows a graph depicting results of an anilox roll and rubber transfer roll ink transient test.

For example, FIG. 4 shows a graph depicting results of an anilox roll and rubber transfer roll ink transient test. Indeed, as shown in FIG. 5, it may take as many as three to four revolutions of an ink transfer roll for the transient to arrive at a steady-state ink thickness. When a rubber ink transfer member, for example, is employed as part of the ink train, ghosting may result from existence of an ink thickness transient.

Systems in accordance with embodiments achieve reduced ghosting, among other reductions in undesirable effects, by cleaning an ink transfer member after transferring ink from an inking system to an imaging member, e.g., digital offset plate or surface. Further, systems in accordance with the embodiments may include removing fountain solution from the surface of the inking member using a fountain solution removal system having, for example, at least one of a doctor blade and an air knife.

While apparatus and systems for digital offset inking are described in relationship to exemplary embodiments, many alternatives, modifications, and variations would be apparent to those skilled in the art. Accordingly, embodiments of apparatus and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A digital offset inking method for erasing ink history useful for ink-based variable data printing using a printing system having a digital offset architecture, the system including a central imaging member, a dampening system for applying dampening fluid to the central imaging member to form a dampening fluid layer, a digital evaporation system for selectively evaporating portions of the dampening fluid layer to according to image data for forming a first image, and an inking system for applying ink to the central imaging member after the evaporating, the inking system comprising an inking member and an ink transfer member, the method comprising:

depositing ink onto a surface of the inking member;

transferring the deposited ink to a surface of the ink transfer member;

transferring the ink from the surface of the ink transfer member to a surface of the imaging member by causing the ink transfer member to contact the imaging member for forming a first ink image on the imaging member; and removing material remaining on the ink transfer member after the transferring the ink from the surface of the ink transfer member to the surface of the imaging member, the removing comprising one of contacting the ink transfer member with an ink removal member and applying an air knife to a surface of the ink transfer member, the removing being before transferring ink from the surface of the ink transfer member to the imaging member for forming a second ink image on the imaging member.

2. The method of claim 1, further comprising:

removing fountain solution from the ink transfer member, the fountain solution being transferred to the ink transfer member during the transferring the ink from the surface of the ink transfer member to the surface of the imaging member.

3. The method of claim 1, wherein the ink removal member comprises an oleophilic surface.

4. The method of claim 3, wherein the oleophilic surface comprises urethane.

5. The method of claim 3, wherein the oleophilic surface comprises ceramic.

6. The method of claim 4, further comprising:

removing the leftover ink from the ink removal member using a cleaning member.

7. The method of claim 6, the cleaning member having an oleophilic surface comprising ceramic.

8. The method of claim 7, further comprising:

removing the leftover ink from the cleaning member using a doctor blade.

9. A digital offset inking system useful for ink-based variable data printing, using a printing system having a digital offset architecture, the system including a central imaging member, a dampening system for applying dampening fluid to the central imaging member to form a dampening fluid layer, a digital evaporation system for selectively evaporating portions of the dampening fluid layer, and the inking system for applying ink to the central imaging member after the evaporating, the inking system comprising:

an inking member, the inking member being an anilox roll;

an ink transfer member for transferring ink to the imaging member; and an ink removal member, wherein material remaining on the ink transfer member is removed after the transferring the ink from the surface of the ink transfer member to the surface of the imaging member and before transferring ink from the surface of the ink transfer member to the imaging member for forming a second ink image on the imaging member.

10. The digital offset inking system of claim 9, further comprising:

a cleaning member for removing the leftover ink from the ink removal member.

11. The digital offset inking system of claim 9, the ink transfer member having a surface comprising rubber.

12. The digital offset inking system of claim 9, the ink removal member having a surface comprising urethane.

13. The digital offset inking system of claim 10, the ink removal member having a surface comprising urethane, and the cleaning member having a surface comprising ceramic.

14. The digital offset inking system of claim 13, the ink removal member having a surface comprising rubber.

15. The digital offset inking system of claim 9, the ink removal member having an oleophilic surface comprising one of urethane and ceramic.

16. The digital offset inking apparatus of claim 10, the cleaning member including a surface comprising ceramic.

* * * * *